US008628364B2

(12) United States Patent
Yamazaki et al.

(10) Patent No.: US 8,628,364 B2
(45) Date of Patent: Jan. 14, 2014

(54) OUTBOARD MOTOR

(75) Inventors: Akihiko Yamazaki, Wako (JP); Hideaki Takada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 212 days.

(21) Appl. No.: 13/114,936

(22) Filed: May 24, 2011

(65) Prior Publication Data

US 2011/0294372 A1 Dec. 1, 2011

(30) Foreign Application Priority Data

May 25, 2010 (JP) ..... 2010-119595

(51) Int. Cl.
*B63H 21/21* (2006.01)

(52) U.S. Cl.
USPC ..... 440/1; 440/87

(58) Field of Classification Search
USPC ..... 440/1, 2, 89 E, 89 R, 84, 87; 123/396, 123/399, 370, 357, 494, 493, 492, 478; 477/112
See application file for complete search history.

(56) References Cited

U.S. PATENT DOCUMENTS

| | | | | |
|---|---|---|---|---|
| 4,526,002 | A | 7/1985 | Bibow | |
| 4,817,466 | A * | 4/1989 | Kawamura et al. | 477/112 |
| 6,446,600 | B1 * | 9/2002 | Scherer et al. | 123/399 |
| 6,921,307 | B2 | 7/2005 | Kashima et al. | |
| 7,249,986 | B2 * | 7/2007 | Otobe et al. | 440/87 |
| 7,343,899 | B2 * | 3/2008 | Kanno et al. | 123/396 |
| 2004/0069271 | A1 * | 4/2004 | Kanno et al. | 123/396 |

FOREIGN PATENT DOCUMENTS

JP 2002-349257 A 12/2002

* cited by examiner

*Primary Examiner* — Lars A Olson
(74) *Attorney, Agent, or Firm* — Arent Fox LLP

(57) ABSTRACT

An outboard motor in which exhaust of an engine is emitted into water via an exhaust passage. The outboard motor comprises a throttle valve connected to an air intake port of the engine via an air intake manifold, a control motor for driving the throttle valve to open and close, and a controller for controlling the control motor. The controller controls the control motor such that the throttle valve fully closes when a determination is made that reverse rotation is occurring in the engine. The exhaust passage is communicated with the air intake manifold via a communication passage. A communication valve which opens only when reverse rotation is occurring in the engine is located at a portion where the communication passage and the air intake manifold connect.

3 Claims, 12 Drawing Sheets

OUTBOARD MOTOR

FIELD OF THE INVENTION

The present invention relates to an improvement in an outboard motor in which negative pressure occurring in an exhaust system is relieved by causing the engine to rotate in reverse.

BACKGROUND OF THE INVENTION

An outboard motor mounted in the rear part of a hull creates thrust in the hull by causing a propeller to rotate using the motive power of an engine. Exhaust created by the driving of the engine is emitted into the water via an exhaust passage. The outboard motor further comprises a shift mechanism for shifting the traveling direction of the hull between forward and reverse. By operating the shift mechanism and shifting the engaged state of the clutch, the rotating direction of the propeller can be reversed. In other words, the clutch shifts the rotating direction of the propeller to forward or reverse in relation to the rotating direction of the engine.

At a point in time when the shift mechanism switches from forward to reverse while the hull is traveling, the flow of water created by the propeller continues in the direction of propelling the hull forward. Therefore, a phenomenon of so-called drag-induced counter-rotation can occur in which the propeller continues to be caused to rotate in the forward-moving direction (the forward rotation direction) by the flow of water in the forward-moving direction. However, the rotating direction of the propeller has been shifted from forward to reverse by the clutch. The engine might be rotating in reverse depending on the operating state. Particularly, the engine could begin to rotate in reverse when the shift mechanism is shifted to reverse while the boat is traveling at a high speed. When the engine rotates in reverse, negative pressure is created in the exhaust passage. As a result, there is a possibility of water being drawn into the exhaust port of the engine via the exhaust passage. Such water intake is preferably eliminated.

For example, Japanese Patent Application Laid-Open Publication No. 2002-349257 (JP 2002-349257 A) discloses an outboard motor designed to prevent water from being drawn in. This outboard motor has a structure in which the exhaust passage of the exhaust system of the engine is communicated with an air intake box of an air intake system of the engine via a communication passage and a one-way valve. The one-way valve is configured so that air is drawn in only to the exhaust passage from the air intake box. When negative pressure is created in the exhaust passage by the reverse rotation of the engine, atmospheric air flows into the exhaust passage via the communication passage and the one-way valve. As a result, negative pressure states in the exhaust passage are eliminated, and water is therefore prevented from entering the exhaust passage. Negative pressure states in the exhaust passage are preferably eliminated more quickly in order to effectively prevent water from entering the exhaust passage.

SUMMARY OF THE INVENTION

An object of the present invention is to provide an outboard motor whereby water can be effectively prevented from entering an exhaust passage.

According to an aspect of the present invention, there is provided an outboard motor in which exhaust emitted by driving of an engine is emitted into water via an exhaust passage, the outboard motor comprising; a throttle valve connected to an air intake port of the engine via an air intake manifold, a control motor for driving the throttle valve to open and close, and a controller for controlling the control motor; wherein the controller controls the control motor so that the throttle valve fully closes when a decision has been made that reverse rotation is occurring in the engine, the exhaust passage is communicated with the air intake manifold via a communication passage, and a communication valve which opens only when reverse rotation is occurring in the engine is located in a portion where the communication passage and the air intake manifold are connected.

In the present invention, the air intake port of the engine is connected to the throttle valve via the air intake manifold. The controller closes the throttle valve to the fully closed state by controlling the control motor when it is determined that reverse rotation is occurring in the engine. Therefore, the air intake manifold is automatically closed off substantially from the atmosphere. The internal pressure of the air intake manifold is increased by the air flowing back from the air intake port of the engine.

When reverse rotation is occurring in the engine, the internal pressure of the exhaust passage becomes negative pressure. However, when reverse rotation is occurring in the engine, the communication valve opens, and the air intake manifold and exhaust passage are therefore communicated with each other via the communication passage. The increased-pressure air in the air intake manifold flows into the exhaust passage via the communication valve and the communication passage. As a result, the negative pressure state in the exhaust passage is relieved. Moreover, since the internal pressure of the air intake manifold is increased, this pressure is positive pressure higher than the atmosphere. There is a large pressure difference between the internal pressure of the air intake manifold and the internal pressure of the exhaust passage. The negative pressure state of the exhaust passage can be relieved more quickly by the large pressure difference. Therefore, water can be effectively prevented from flowing into the exhaust passage.

Furthermore, the communication valve opens only when reverse rotation is occurring in the engine. Therefore, the communication valve stays closed when the engine is operating as usual (undergoing forward rotation). Exhaust produced by the engine does not flow back from the exhaust passage to the air intake manifold via the communication passage.

Furthermore, when reverse rotation is occurring in the engine, the internal pressure of the air intake manifold suddenly increases due to the air flowing back from the air intake port of the engine. As a countermeasure to this, the communication valve is located in the portion where the communication passage and the air intake manifold connect in the present invention. Therefore, the distance in which the air intake manifold and the communication valve connect is extremely short. When the communication valve is open, the air in the air intake manifold flows extremely quickly into the negative pressure communication passage. As a result, excessive pressure increases in the air intake manifold can be quickly avoided.

Preferably, the communication valve comprises a reed valve or a like check valve which opens when the internal pressure of the air intake manifold is higher than the internal pressure of the exhaust passage. Therefore, the communication valve, which opens only when reverse rotation is occurring in the engine, has a simple configuration as well as high durability. Furthermore, there is no need for electric control for opening the communication valve.

It is desirable that the communication valve comprise an electromagnetic valve, and the controller control the electromagnetic valve so as to open when a decision has been made that reverse rotation is occurring in the engine. Therefore, when the controller has determined that reverse rotation is occurring in the engine, the electromagnetic valve can be opened either simultaneously or nearly simultaneously with the closing of the throttle valve to a fully closed state. In other words, the electromagnetic valve can be opened even before the pressure difference between the internal pressure of the air intake manifold and the internal pressure of the exhaust passage reaches a specified value. The negative pressure state of the exhaust passage can be relieved even more quickly.

BRIEF DESCRIPTION OF THE DRAWINGS

Certain preferred embodiments of the present invention will be described in detail below, by way of example only, with reference to the accompanying drawings, in which.

DETAILED DESCRIPTION OF THE PREFERRED EMBODIMENTS

First Embodiment

An outboard motor 10 according to the first embodiment is described hereinbelow based on FIGS. 1 through 8.

Figure 1:
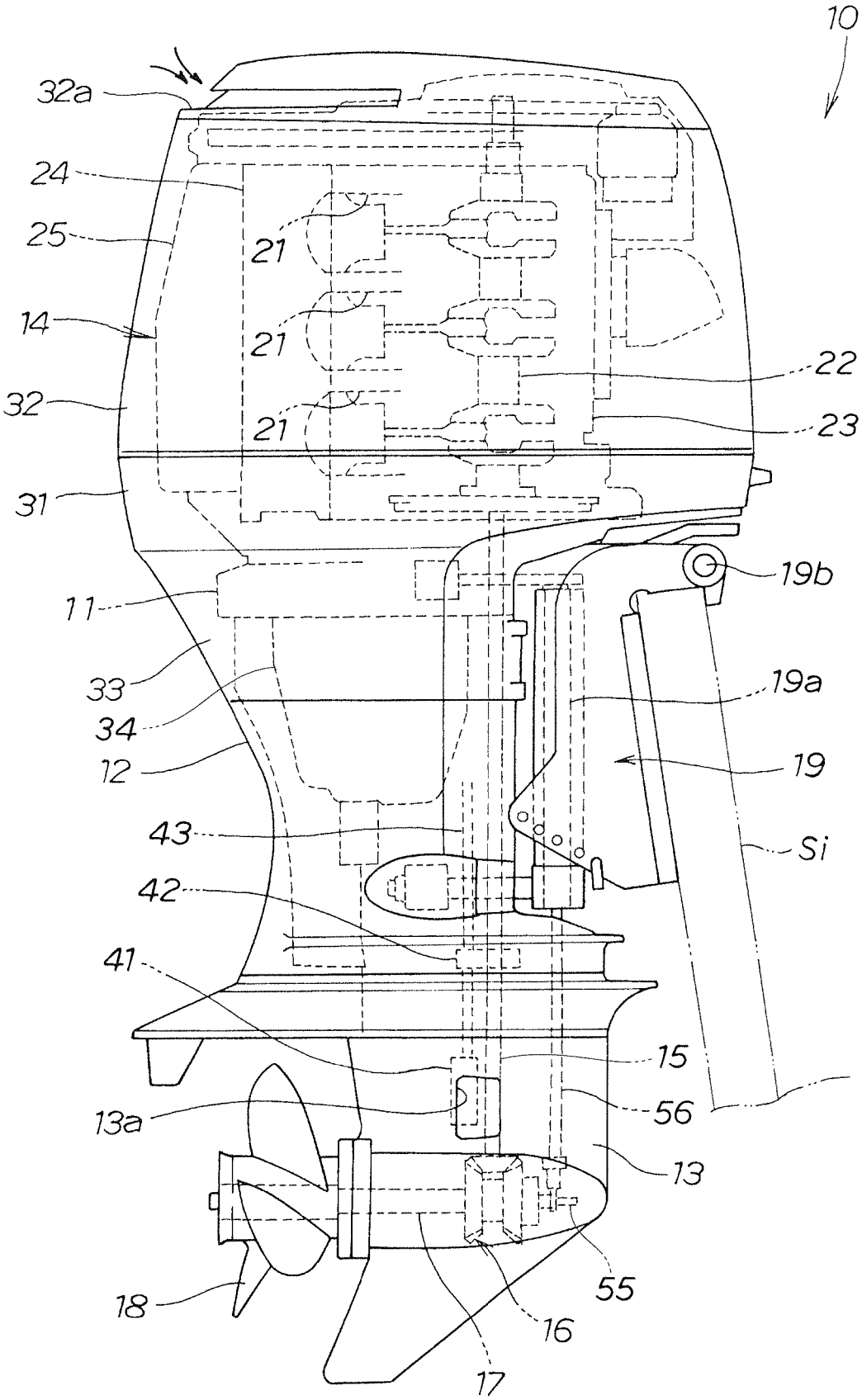
FIG. 1 is a side view of an outboard motor according to a first embodiment of the present invention.
Figure 2:
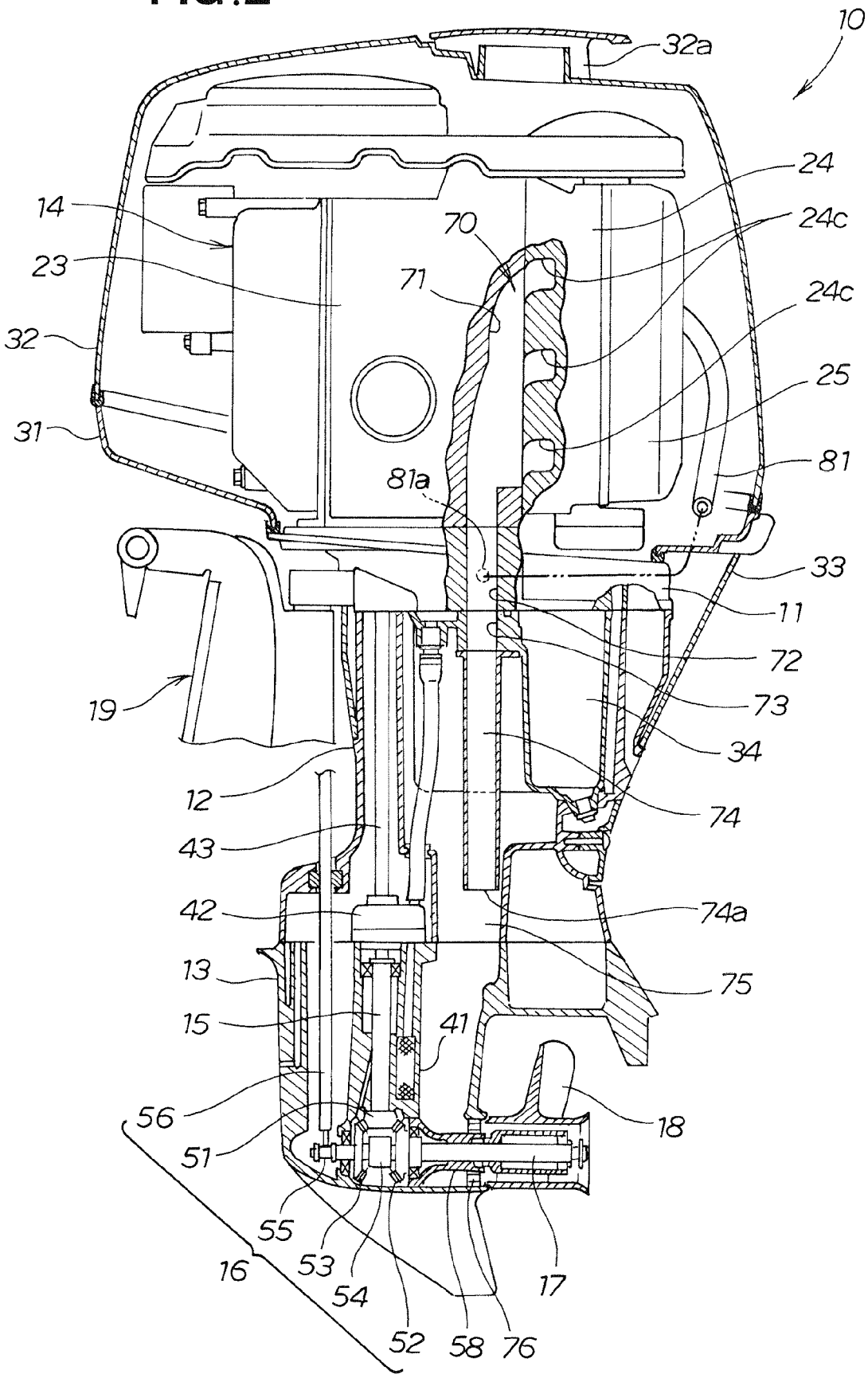
FIG. 2 is a side view showing in cross section part of the outboard motor of FIG. 1.
Figure 3:
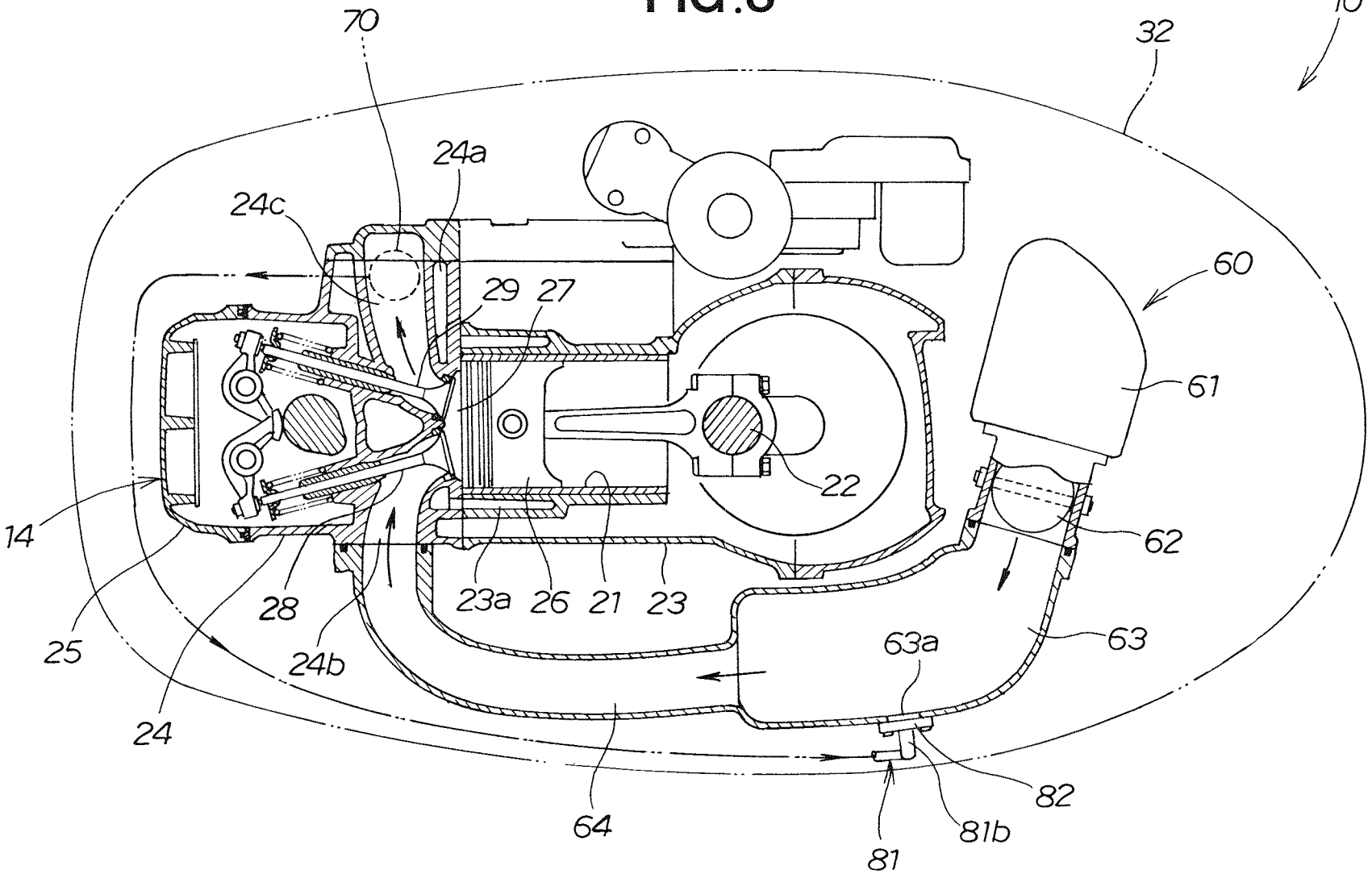
FIG. 3 is a top plan view showing in cross section an air intake system of the outboard motor shown in FIG. 2.

The outboard motor 10 is composed of a mount case 11, an extension case 12, a gear case 13, an engine 14, a drive shaft 15, a gear mechanism 16, a propeller shaft 17, a propeller 18, and an outboard motor mounting mechanism 19, as shown in FIGS. 1 through 3.

The outboard motor mounting mechanism 19 is used to affix the outboard motor 10 to the hull Si, and is capable of swinging the outboard motor 10 in a left-right direction about a swivel shaft 19*a*, as well as raising the outboard motor 10 somewhat in the clockwise direction of FIG. 1 about a tilt shaft 19*b*.

The mount case 11 is a so-called engine support case where the engine 14 is mounted on the top surface. The extension case 12 is attached to the bottom part of the mount case 11. The gear case 13 is attached to the bottom part of the extension case 12.

The engine 14 is a water-cooled vertical multi-cylinder engine (e.g., a three-cylinder engine) whose primary structural elements are cylinders 21, a crankshaft 22, a cylinder block 23, a cylinder head 24, a head cover 25, a piston 26, a combustion chamber 27, an air intake valve 28, and an air exhaust valve 29.

In the engine 14 described above, the axis lines of the cylinders 21 vertically aligned in parallel are oriented horizontally (substantially horizontally), and the crankshaft 22 is aligned vertically. The bonding surface between the horizontally oriented cylinder block 23 and cylinder head 24 is a substantially vertical surface, as is the bonding surface between the cylinder head 24 and the head cover 25. The cylinder block 23 and the cylinder head 24 have respective cooling water jackets 23*a*, 24*a*.

Furthermore, the engine 14 is covered by a lower under cover 31 and an upper engine cover 32. The engine cover 32 has an fresh-air intake hole 32*a* in the top. Outside air is led into the engine cover 32 from the fresh-air intake hole 32*a*. The tops of the mount case 11 and the extension case 12 are covered by an under cover 33.

An oil pan 34 is attached to the bottom of the mount case 11 inside the extension case 12. Lubricating oil accumulated in the oil pan 34 is supplied to sliding components in the engine 14.

A cooling water screen 41, a water pump 42, and a cooling water supply tube 43 are accommodated in the extension case 12 and the gear case 13. The gear case 13 has a water inlet 13*a*. Cooling water (seawater or the like) taken into the gear case 13 through the water inlet 13*a* by the water pump 42 is supplied to the cooling water jackets 23*a*, 24*a* of the engine 14 through the cooling water screen 41 and the cooling water supply tube 43, where it cools the cooling regions in the cylinder block 23, the cylinder head 24, and other components of the engine 14. The cooling water is then expelled to the exterior.

The drive shaft 15 is a vertical shaft accommodated in the extension case 12 and extending in a vertical direction, the top end being connected to the crankshaft 22 of the engine 14.

Figure 5:
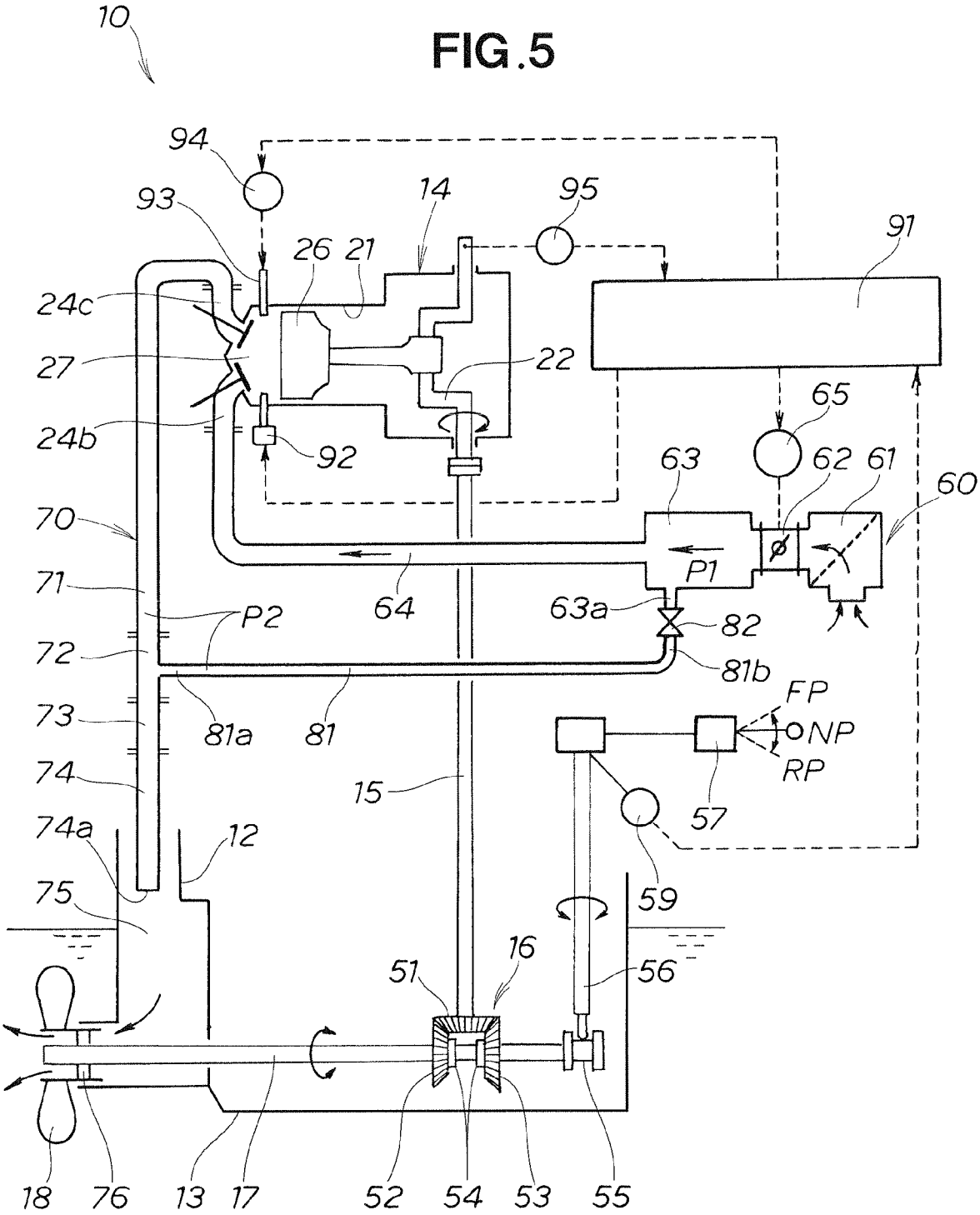
FIG. 5 is a systematic diagram schematically depicting the outboard motor shown in FIG. 1.

The gear mechanism 16 is accommodated in the gear case 13, as shown in FIGS. 2 and 5. The gear mechanism 16 is composed of a drive bevel gear 51 provided to the bottom end of the drive shaft 15, a pair of driven bevel gears 52, 53 for forward and reverse movement provided to the propeller shaft 17, a dog clutch 54 for switching between forward and reverse movement, a clutch switch mechanism (shift mechanism) 55 for switching the dog clutch 54, an operating shaft 56 for switching the clutch switch mechanism 55, and an operating lever 57 (FIG. 5) for switching the operating shaft 56.

The propeller shaft 17 is rotatably supported on the gear case 13 via a propeller shaft holder 58. The propeller shaft holder 58 is accommodated inside the gear case 13. The rear end of the propeller shaft holder 58 protrudes rearward from the gear case 13. A through-hole (ventilation hole) 76 passing entirely through the gear case 13 is provided in the external periphery of the protruding portion of the propeller shaft holder 58.

The motive power of the engine 14 is transmitted to the propeller 18 via the crankshaft 22, the drive shaft 15, the drive bevel gear 51, the pair of driven bevel gears 52, 53, the dog clutch 54, and the propeller shaft 17.

Referring to FIG. 5, the operating lever (switch operation member) 57 switches between a forward-movement position FP, a neutral position NP, and a reverse-movement position RP. When the operating lever 57 is switched from the forward-movement position FP to the reverse-movement position RP or vice versa, the operating lever 57 temporarily passes through the neutral position NP while switching.

When the operating lever 57 is in the neutral position NP, the switch mode (shift mode) of the clutch switch mechanism 55 is a neutral mode. In other words, when the operating lever 57 is in the neutral position NP, the dog clutch 54 is in a disabled state. Therefore, the rotation of the propeller 18 stops because the motive power of the engine 14 is not transmitted from the drive shaft 15 to the propeller shaft 17.

When the operating lever 57 is in the forward-movement position FP, the switch mode of the clutch switch mechanism 55 is a forward-movement mode. In other words, when the operating lever 57 is in the forward-movement position FP, the dog clutch 54 switches toward forward movement. Therefore, the motive power is transmitted from the drive shaft 15 to the propeller 18 via the drive bevel gear 51, the driven bevel gear 52 for forward movement, the dog clutch 54, and the propeller shaft 17. As a result, the propeller 18 creates thrust in the forward direction by rotating forward, and the hull Si is propelled forward.

When the operating lever 57 is in the reverse-movement position RP, the switch mode of the clutch switch mechanism 55 is a reverse-movement mode. In other words, when the operating lever 57 is in the reverse-movement position RP, the dog clutch 54 switches toward reverse movement. Therefore, the motive power is transmitted from the drive shaft 15 to the propeller 18 via the drive bevel gear 51, the driven bevel gear 53 for reverse movement, the dog clutch 54, and the propeller shaft 17. As a result, the propeller 18 creates thrust in the reverse direction by rotating in reverse, and the hull Si is propelled backward.

A neutral sensor 59 detects whether or not the switch mode of the clutch switch mechanism 55 is in a neutral mode NP. The neutral sensor 59 produces an on detection signal only during the neutral mode NP and produces an off detection signal during the forward-movement mode or the reverse-movement mode.

Figure 4:
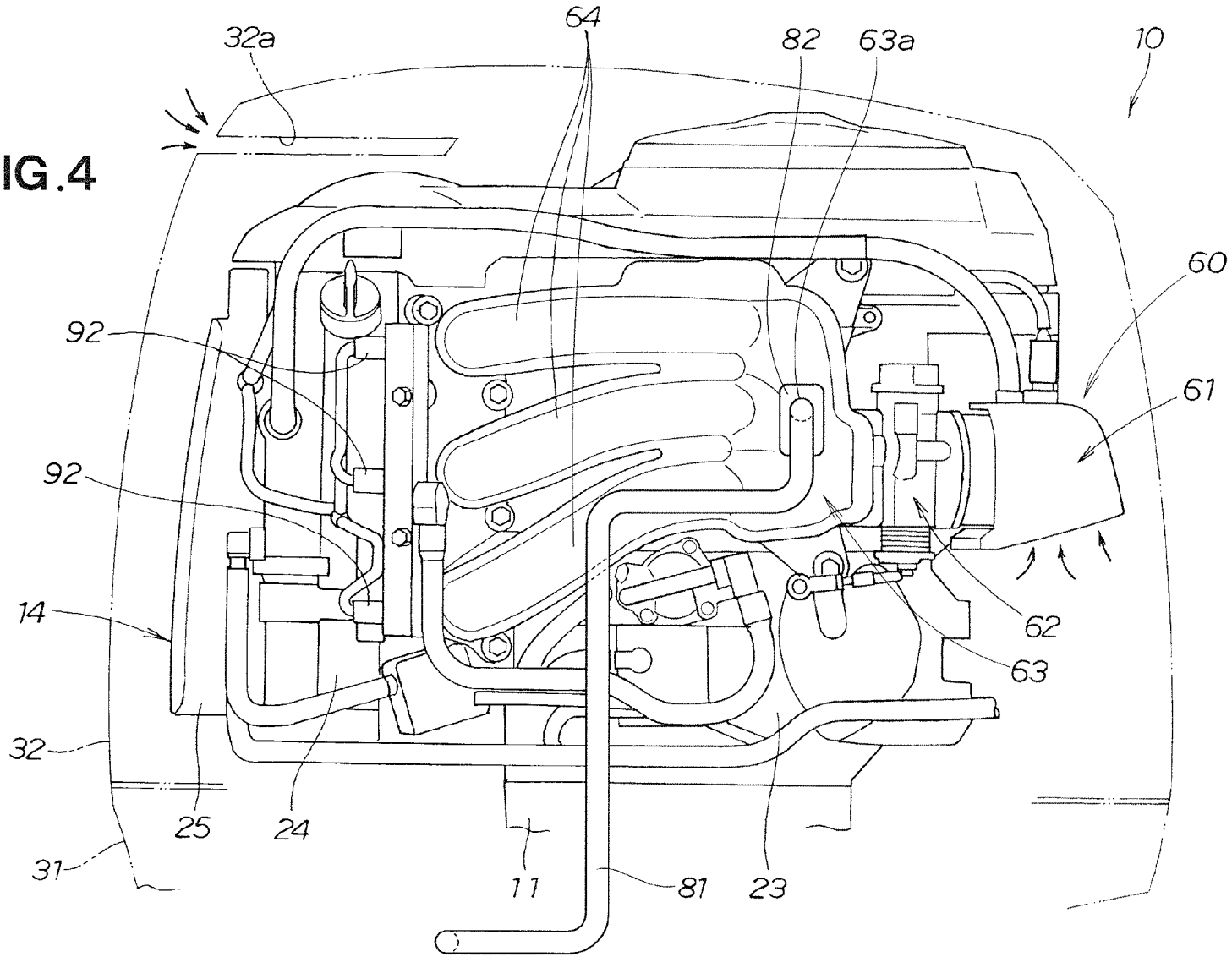
FIG. 4 is a side view showing part of the air intake system of the outboard motor of FIG. 2.

Outside air led into the engine compartment formed by the engine cover 32 is supplied to the engine 14 via an air intake system 60 as shown in FIGS. 3 through 5. To be specific, the air intake system 60 is composed of an air intake silencer (air intake box) 61, a throttle valve 62, and an air intake manifold 63.

The throttle valve 62 is driven to open and close by a control motor 65 (FIG. 5). The air intake manifold 63 is disposed so as to extend along the right side of the engine 14, and the air intake manifold 63 has air intake branching tubes 64 of a number corresponding to the number of cylinders (e.g., three cylinders) of the engine 14. The air intake branching tubes 64 are connected to air intake ports 24*b* of the engine 14. The throttle valve 62 is connected to the air intake ports 24*b* via the downstream air intake manifold 63. Therefore, outside air is supplied to the air intake ports 24*b* downstream and led into the combustion chamber 27 of the engine 14 via the air intake silencer 61, the throttle valve 62, and the air intake manifold 63.

The exhaust emitted by the engine 14 is emitted into the water via an exhaust system (exhaust passage) 70, as shown in FIGS. 2, 3, and 5. The exhaust passage 70 is composed of an exhaust manifold 71 connected to exhaust ports 24*c* of the engine 14, a first exhaust passage 72 formed in the mount case 11, a second exhaust passage 73 formed in the oil pan 34, an exhaust tube 74 connected to the bottom end of the second exhaust passage 73, an exhaust expansion chamber 75 formed in the extension case 12, and an exhaust port 76 formed in the rear bottom part of the gear case 13. The exhaust tube 74 is communicated with the exhaust expansion chamber 75.

The bottom of the outboard motor 10 is under water, and during a propelling state enacted by the propeller 18, the exhaust emitted by the engine 14 is emitted into the water via the exhaust manifold 71, the first exhaust passage 72, the second exhaust passage 73, the exhaust tube 74, the exhaust expansion chamber 75, and the exhaust port 76.

The exhaust passage 70 is communicated with the air intake manifold 63 via a communication passage 81 and a communication valve 82 as shown in FIGS. 2 through 5. The communication passage 81 is composed of a tube. For example, one end 81*a* of the communication passage 81 is connected to the first exhaust passage 72. The other end 81*b* of the communication passage 81 is connected to a communication port 63*a* formed in the air intake manifold 63.

Figure 6:
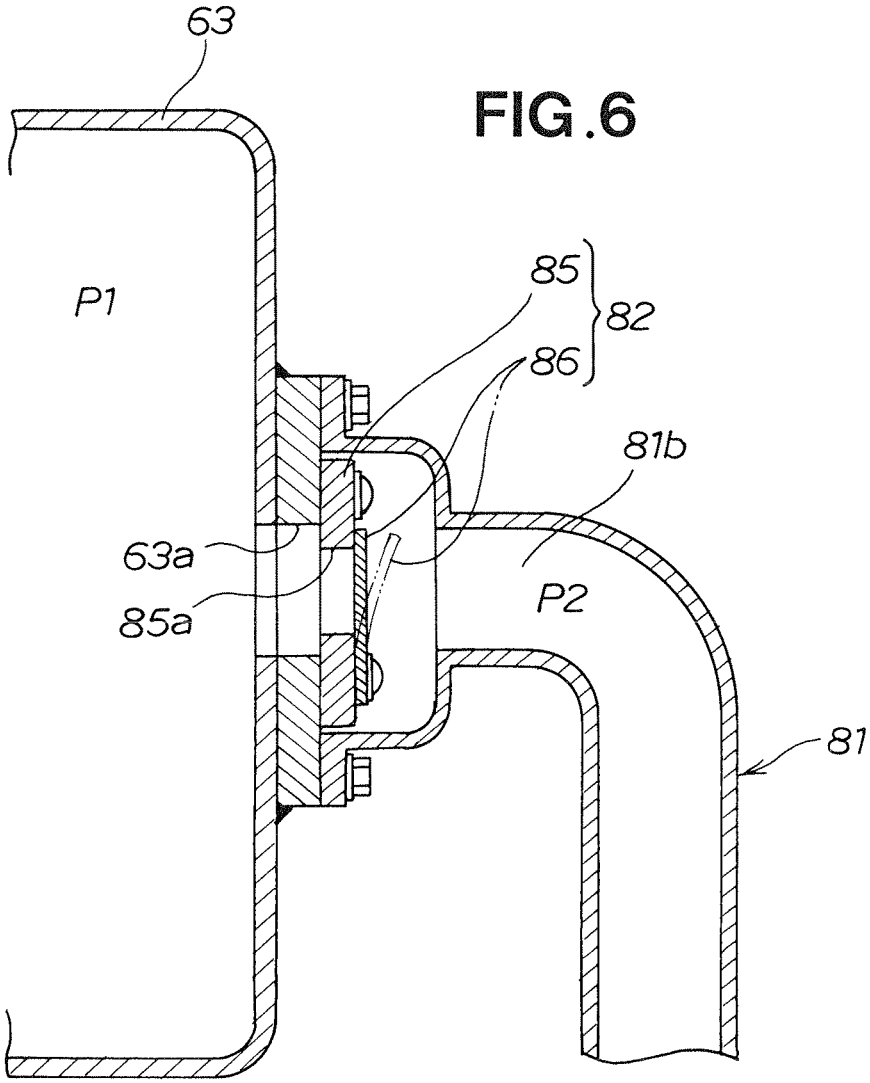
FIG. 6 is a cross-sectional view showing a communication valve of FIG. 5.

The communication valve 82 is located in the connecting portion 63*a* between the communication passage 81 and the air intake manifold 63, or in other words is attached directly to the communication port 63*a*, as shown in FIGS. 5 and 6. The communication valve 82 is configured from a reed valve or another check valve which opens when the internal pressure P1 of the air intake manifold 63 is higher than the internal pressure P2 of the exhaust passage 70 (P1>P2). For example, the communication valve 82 is configured from a reed valve as shown in FIG. 6. The reed valve (communication valve) 82 is composed of a flat, plate-shaped slot plate 85 attached to the communication port 63*a*, and a thin, plate-shaped reed valve body 86 attached at one end to the slot plate 85 such that a hole 85*a* of the slot plate 85 can be opened and closed.

When the internal pressure P1 of the air intake manifold 63 is lower than the internal pressure P2 of the other end 81*b* of the communication passage 81, i.e. the internal pressure P2 of the exhaust passage 70 (P1<P2), the reed valve body 86 is in a closed off state as shown by the solid lines (the reed valve 82 is closed). Therefore, the communication passage 81 communicating the exhaust passage 70 and the air intake manifold 63 is in a closed off state.

When the internal pressure P1 of the air intake manifold 63 is higher than the internal pressure P2 of the other end 81*b* of the communication passage 81 (P1>P2), the reed valve body 86 is in an open state as shown by the imaginary lines (the reed valve 82 is open). As a result, the communication passage 81 communicating the exhaust passage 70 and the air intake manifold 63 is in an open state.

The engine 14 is a so-called electronic control engine which is controlled electrically by a controller 91, as shown in FIG. 5. The engine 14 comprises an injector 92 for supplying fuel to the combustion chamber 27, an ignition plug 93 for igniting the fuel supplied to the combustion chamber 27, and an ignition coil 94 for supplying high-voltage electric power to the ignition plug 93.

The controller 91 receives detection signals from the neutral sensor 59, a speed sensor 95 for detecting the rotating speed of the engine 14, and other various sensors, for example; and controls the control motor 65, the injector 92, and the ignition coil 94. Furthermore, the controller 91 controls the control motor 65 so as to close the throttle valve 62 to the fully closed state.

Figure 7:
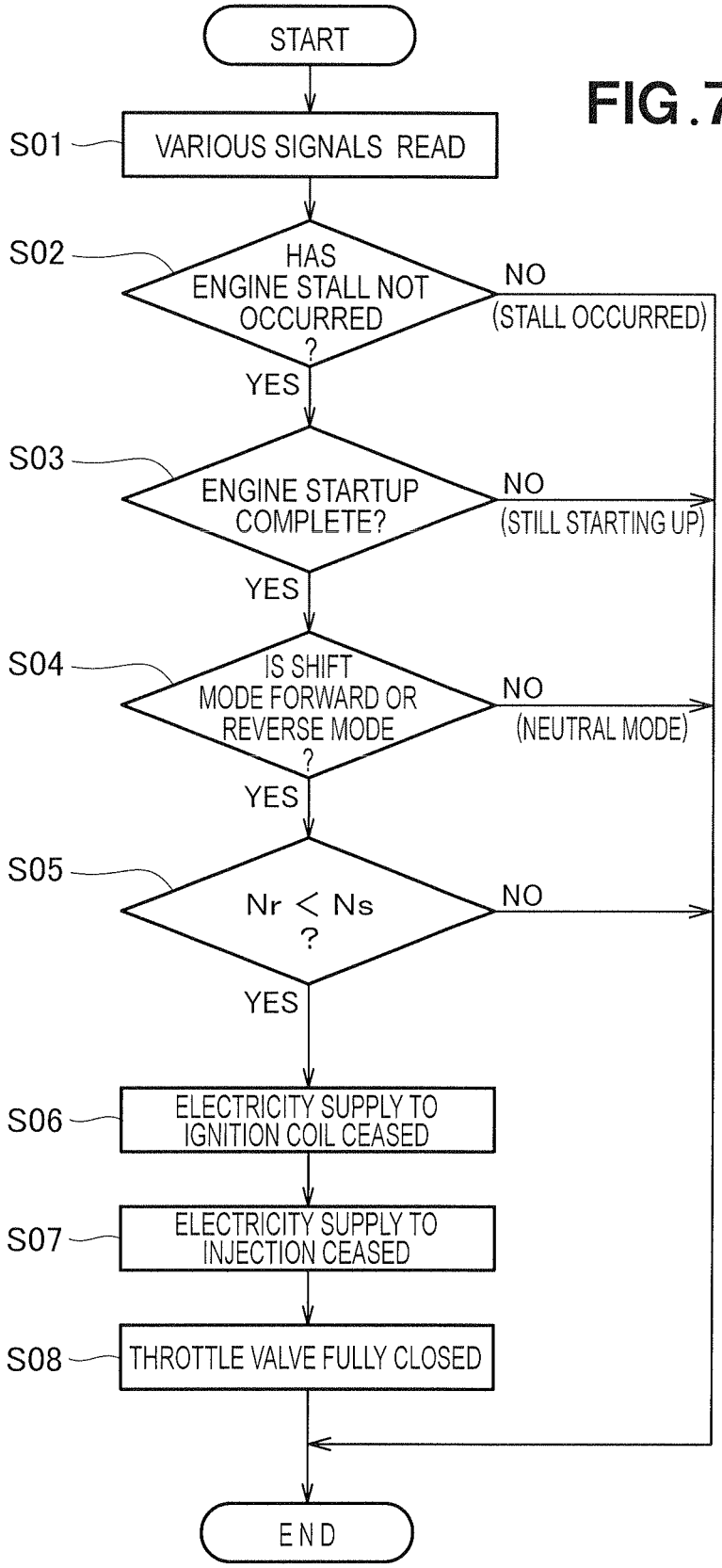
FIG. 7 is a control flowchart of a controller shown in FIG. 5.

The following is a description, made based on FIG. 7 with reference to FIG. 5, of the control flow when the controller 91 is configured from a microprocessor. This control flowchart shows an example of control in which the controller 91 performs time shared control (performed at specified extremely small time intervals).

In the control flowchart shown in FIG. 7, the controller 91 reads various signals, e.g. detection signals of the neutral sensor 59 and the speed sensor 95 in step S01.

Next, in step S02, a determination is made as to whether or not an engine stall has occurred. The term "engine stall" refers to the rotation of the engine 14 ceasing for any reason. An engine stall can occur in cases such as when an external force takes effect which is greater than the drive force produced by the engine 14. When it is determined in step S02 that an engine stall has occurred, the control is ended.

When it is determined in step S02 that an engine stall has not occurred, a determination in step S03 is made as to whether or not the startup of the engine 14 has completed. In other words, when the started engine 14 transitions to a stable idling state, the controller 91 determines that "startup has completed." For example, when the actual rotating speed Nr of the engine 14 reaches the rotating speed during the idling state (the idling rotating speed), startup of the engine 14 can be determined to have completed.

When it is determined in step S03 that the engine 14 has not yet started up, the control is ended. When it is determined in step S03 that the startup of the engine 14 has completed, the process advances to step S04. When it is determined in step S03 that the startup of the engine 14 has completed, this determination result is preserved by being stored in memory.

In step S04, a determination is made as to whether or not the shift mode of the clutch switch mechanism 55 is in either forward mode or reverse mode. When it is determined in step S04 that the switch mode is in neutral mode, the control is ended.

When it is determined in step S04 that the shift mode is in either forward mode or reverse mode, a determination is then made in step S05 as to whether or not the speed Nr at which the engine 14 is actually rotating (the actual rotating speed Nr) is less than an engine lower limit reference speed Ns. The actual rotating speed Nr is a value detected by the speed sensor 95. The engine lower limit reference speed Ns is a specified value set in advance in order to determine whether or not the reverse rotation phenomenon has occurred in the engine 14.

To be more specific, the engine lower limit reference speed Ns is set to a rotating speed which is in effect immediately before a forward-rotating engine 14 begins to rotate in reverse, and is set to a value which is less than the rotating speed during the idling state (the idling rotating speed) and greater than "0." It is particularly preferable to be near the value "0" (not a state of engine stalling, however). For example, when the idling rotating speed is 600 to 900 rpm, the engine lower limit reference speed Ns is set to 200 to 300 rpm.

When it is determined in step S05 that the actual rotating speed Nr has reached the engine lower limit reference speed Ns, i.e. that the actual rotating speed Nr is equal to or greater than the engine lower limit reference speed Ns ($Nr \geq Ns$), it is determined that the reverse rotation phenomenon is not occurring in the engine 14, and the control is ended.

When it is determined in step S05 that the actual rotating speed Nr is less than the engine lower limit reference speed Ns ($Nr < Ns$), since it is determined that the reverse rotation phenomenon has occurred in the engine 14, control is ended after the next steps S06 to S08 have been performed. In other words, the electricity supply to the ignition coil 94 is ceased in step S06, the electricity supply to the injector 92 is ceased in step S07 (the fuel supply is ceased), and the throttle valve 62 is fully closed in step S08. In step S08, the throttle valve 62 is closed to the fully closed state by controlling the control motor 65. As a result, the engine 14 stops automatically.

Thus, under the condition that the startup of the engine 14 be complete (step S03), the controller 91 determines that "the reverse rotation phenomenon has occurred in the engine 14," closes the throttle valve 62 to the fully closed state, and stops the engine 14 when two conditions have both been met: a first condition that the shift mode be in either forward mode or reverse mode (step S04), and a second condition that the actual rotating speed Nr be less than the engine lower limit reference speed Ns (step S05).

Figure 8:
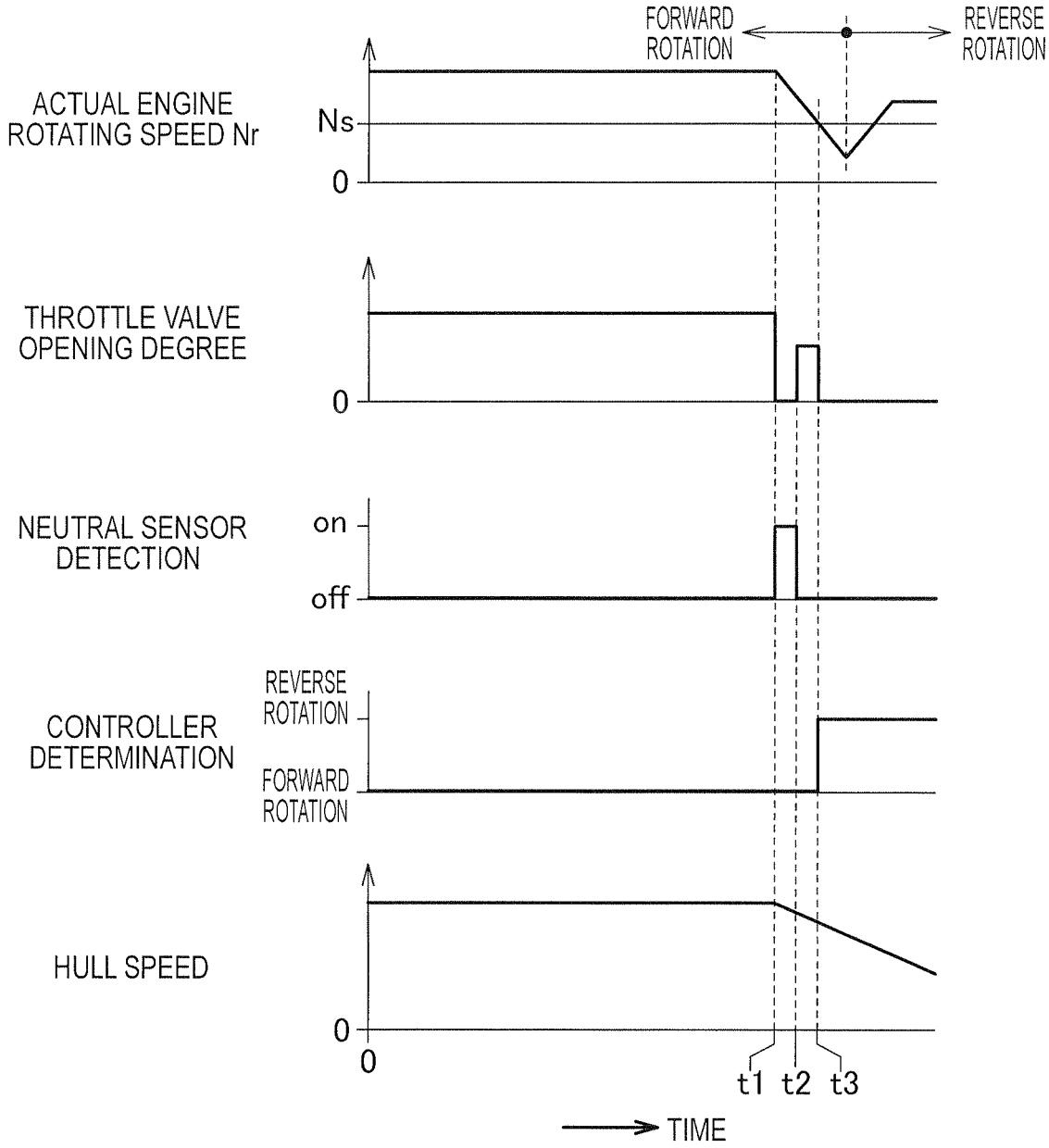
FIG. 8 is a time chart illustrating an operation of components of the outboard motor shown in FIG. 5.
Figure 9:
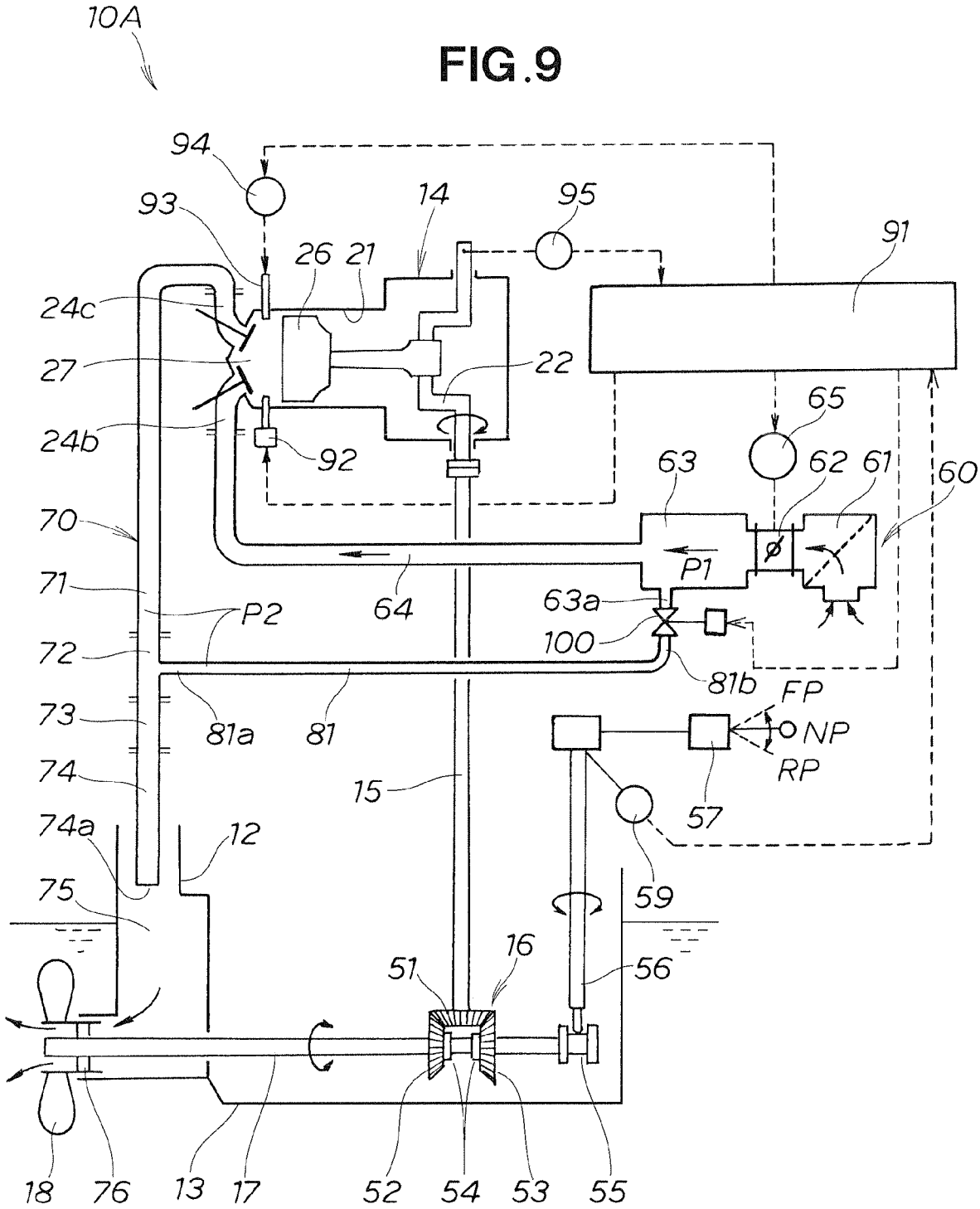
FIG. 9 is a systematic diagram schematically illustrating an outboard motor according to a second embodiment of the present invention.

Next, an example of the action of the outboard motor 10 and the hull Si equipped with the outboard motor 10 will be described based on FIG. 8 with reference to FIG. 5. FIG. 8 shows the elapsed time on the horizontal axes, and the actions of the components on the vertical axes. The actual rotating speed Nr of the engine 14 shown in FIG. 8 is shown as an absolute value.

The engine 14 is now completely started up and is rotating forward at a high speed, and the actual rotating speed Nr exceeds the engine lower limit reference speed Ns. The propeller 18 creates thrust in the forward-moving direction by rotating forward, and the hull Si is propelled forward at a high speed. The controller 91 automatically controls the opening degree of the throttle valve 62 in accordance with the extent of the thrust (load) created by the propeller 18. The switch mode of the clutch switch mechanism 55 is in the forward mode, and the detection signal of the neutral sensor 59 is therefore off. In this state, the controller 91 determines that the engine 14 is rotating forward.

In this state of high-speed travel, the operator switches the operating lever 57 to the reverse-movement position RP. When the operating lever 57 is switched from the forward-movement position FP to the reverse-movement position RP, the operating lever 57 temporarily passes through the neutral position NP during the switching. In other words, at time t1, the operating lever 57 moves from the forward-movement position FP to the neutral position NP, and at time t2, the operating lever 57 continues to move from the neutral position NP to the reverse-movement position RP. Thus, the operating lever 57 temporarily passes through the neutral position NP during the extremely short amount of time from time t1 to time t2 during the switching. When the lever is passing through the neutral position NP (the neutral mode), the detection signal of the neutral sensor 59 is on. When the controller 91 is receiving the on signal of the neutral sensor 59, the engine 14 is put into idling. In other words, the controller 91 controls the control motor 65 so as to close the throttle valve 62 to the fully closed state. As a result, the actual rotating speed Nr of the engine 14 decreases.

Since the engine 14 transitions from the forward mode to the neutral mode at time t1, the dog clutch 54 is disabled and the connection between the drive shaft 15 and the propeller shaft 17 is blocked. The motive power of the engine 14 is not transmitted from the drive shaft 15 to the propeller shaft 17. However, the flow of water created by the propeller 18 still maintains a flow in a direction of propelling the hull Si forward. Therefore, the phenomenon of so called drag-induced counter-rotation occurs, in which the propeller 18 continues to be caused to rotate in the forward-moving direction (the forward rotation direction) by the flow of water in the forward-moving direction. The hull Si continues to move forward while gradually losing speed.

The operating lever 57 moves from the neutral position NP to the reverse-movement position RP at time t2 which occurs at an extremely short amount of time after time t1. In other words, a transition is made from neutral mode to reverse mode. The detection signal of the neutral sensor 59 reverses from on to off. The controller 91 receives the off signal of the neutral sensor 59 and controls the control motor 65 so as to re-open the throttle valve 62. The engine 14 continues to rotate forward.

At time t2, the dog clutch 54 in the shutoff state switches toward reverse, whereby the driven bevel gear 53 for reverse and the propeller shaft 17 are connected. The engine 14 continues to rotate forward, causing the propeller 18 to rotate in reverse via the drive shaft 15, the drive bevel gear 51, the driven bevel gear 53 for reverse, the dog clutch 54, and the propeller shaft 17.

However, at time t2, the water flow in the forward-moving direction is still continuing, and the propeller 18 is being caused to rotate in the forward-moving direction by this water flow (the phenomenon of drag-induced counter-rotation). At time t2, the engine 14 is transitioning from the idling state back to a high-speed state, but the output is still low. An un-illustrated force fp (reverse force fp), at which the propeller 18 is caused to rotate in the forward-moving direction by the water flow attempts to caused the engine 14 to rotate, could possibly exceed an un-illustrated force fe (engine motive power fe), at which the engine 14 at low output attempts to cause the propeller 18 to rotate. When the reverse force fp is greater than the engine motive power fe (fp>fe), the actual rotating speed Nr of the engine 14 decreases further. Furthermore, when the reverse force fp is even greater than the engine motive power fe, the engine 14 is caused to rotate in reverse by the propeller 18.

In the first embodiment, the actual rotating speed Nr of the engine 14 (i.e. the rotating speed in the forward rotation direction+Nr) decreases due to the reverse force fp being greater than the engine motive power fe, and when the actual rotating speed Nr falls below the engine lower limit reference speed Ns, i.e. at time t3, the controller 91 acknowledges (determines) that reverse rotation is occurring in the engine 14, closes the throttle valve 62 to the fully closed state, and stops the engine 14. Therefore, the actual rotating speed Nr of the engine 14 further decreases. As a result, the reverse force fp exceeds the engine motive power fe, and the engine 14 is therefore caused to rotate in reverse by the propeller 18.

Furthermore, since the throttle valve 62 is fully closed, the air intake manifold 63 becomes substantially closed, and the internal pressure P1 becomes positive pressure due to the air flowing back in from the engine 14. When reverse rotation is occurring in the engine 14, the internal pressure P2 of the exhaust passage 70 becomes negative pressure. Since the communication valve 82 opens at this time, the air in the air intake manifold 63 flows into the exhaust passage 70 via the communication valve 82 and the communication passage 81. As a result, the negative pressure state of the exhaust passage 70 is relieved.

The description of the first embodiment is summarized as follows. The air intake port 24*b* of the engine 14 is connected to the throttle valve 62 via the air intake manifold 63. The controller 91 closes the throttle valve 62 to the fully closed state by controlling the control motor 65 when it has determined that reverse rotation is occurring in the engine 14. Therefore, the air intake manifold 63 is automatically blocked off substantially from the atmosphere. The internal pressure P1 of the air intake manifold 63 is increased by the air (including gas) that has flowed back in from the air intake port 24*b* of the engine 14.

When reverse rotation is occurring in the engine 14, the internal pressure P2 of the exhaust passage 70 becomes negative pressure. However, since the communication valve 82 opens when reverse rotation is occurring in the engine 14, the air intake manifold 63 and the exhaust passage 70 are communicated via the communication passage 81. The increased-pressure air in the air intake manifold 63 flows into the exhaust passage 70 via the communication valve 82 and the communication passage 81. As a result, the negative pressure state of the exhaust passage 70 is relieved. Moreover, since the internal pressure P1 of the air intake manifold 63 is increased, it is positive pressure higher than atmospheric pressure. The pressure difference between the internal pressure P1 of the air intake manifold 63 and the internal pressure P2 of the exhaust passage 70 is large. Due to the large pressure difference, the negative pressure state of the exhaust passage 70 can be relieved more quickly. Therefore, water can be effectively prevented from entering the exhaust passage 70.

Furthermore, the communication valve 82 opens only when reverse rotation is occurring in the engine 14. Therefore, when the engine 14 is operating normally (rotating forward), the communication valve 82 is closed off. The exhaust produced by the engine 14 does not flow from the exhaust passage 70 back into the air intake manifold 63 via the communication passage 81.

When reverse rotation is occurring in the engine 14, the internal pressure P1 of the air intake manifold 63 suddenly increases due to the air flowing back in from the air intake port 24*b* of the engine 14. In the first embodiment, the communication valve 82 is located in the connecting portion between the communication passage 81 and the air intake manifold 63, i.e. in the communication port 63*a*. Therefore, the distance over which the air intake manifold 63 and the communication valve 82 are connected is extremely short. When the communication valve 82 has opened, the air in the air intake manifold 63 flows into the negative-pressure communication passage 81 very quickly. As a result, excessive pressure rises in the air intake manifold 63 can be quickly avoided.

The communication valve 82 is configured from a reed valve or another check valve which opens when the internal pressure P1 of the air intake manifold 63 is higher than the internal pressure P2 of the exhaust passage 70. Therefore, the communication valve 82, which opens only when reverse rotation is occurring in the engine 14, has a simple configuration and has high durability. Furthermore, there is no need for electrical control for opening the communication valve 82.

The inventors conducted comparative tests using a first test device equivalent to the outboard motor 10 of the first embodiment shown in FIG. 5, and a second test device equivalent to a conventional outboard motor.

The first test device had a configuration in which the exhaust passage 70 was communicated with the communication port 63*a* of the air intake manifold 63 via the communication passage 81, and the communication valve 82, i.e. the reed valve 82 which opens only when reverse rotation is occurring in the engine 14, is located between the communication port 63*a* and the other end 81*b* of the communication passage 81. Furthermore, in the test using the first test device, the throttle valve 62 was closed to the fully closed state with the timing at which the actual rotating speed Nr of the engine 14 fell below the engine lower limit reference speed Ns.

The second test device had essentially the same configuration as the first test device, but the exhaust passage 70 was not communicated with the air intake manifold 63.

The results of conducting the tests were as follows.

With the second test device (the conventional equivalent product), the maximum value of the internal pressure (positive pressure) P1 of the air intake manifold 63 was 200 to 250 kPa, while the internal pressure (negative pressure) P2 of the exhaust passage 70 was −25 to 0 kPa.

With the first test device (the product equivalent to the first embodiment), the maximum value of the internal pressure (positive pressure) P1 of the air intake manifold 63 was 100 to 150 kPa, while the internal pressure (negative pressure) P2 of the exhaust passage 70 was −10 to 0 kPa.

Thus, it was confirmed that with the first test device, the negative pressure of the exhaust passage 70 was reduced further than with the second test device.

Second Embodiment

Next, an outboard motor 10A according to the second embodiment is described based on FIGS. 9 through 12. The outboard motor 10A according to the second embodiment is characterized in that the communication valve 82 of the first embodiment shown in FIG. 5 is modified to a communication valve 100 shown in FIG. 9, but the configuration is otherwise identical to the configuration shown in FIGS. 1 through 8 and is not described.

Specifically, the communication valve 100 of the second embodiment is configured from an electromagnetic valve. When it has been determined that reverse rotation is occurring in the engine 14, the controller 91 of the second embodiment controls the control motor 65 so that the throttle valve 62 is closed to the fully closed state and also controls the communication valve 100 so as to open.

Figure 10:
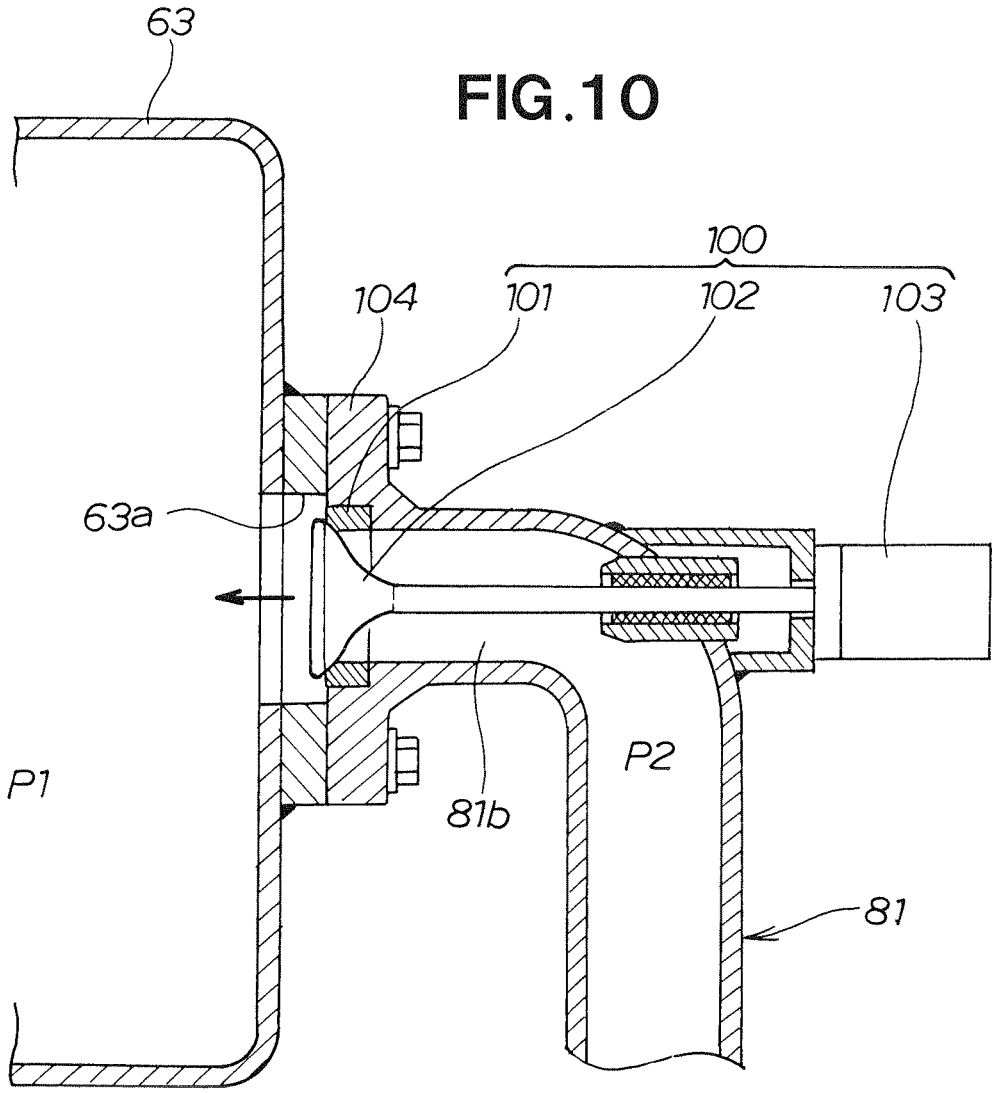
FIG. 10 is a cross-sectional view showing a communication valve of FIG. 9.

The electromagnetic valve 100 (the communication valve 100) is located in the connecting portion 63*a* between the communication passage 81 and the air intake manifold 63, i.e. is attached directly to the communication port 63*a*, as shown in FIG. 10. The electromagnetic valve 100 is composed of a valve seat 101, a valve body 102, and a solenoid 103. The valve seat 101 is an annular member position in proximity to the communication port 63*a*, and is provided to a mounting flange 104 of the other end 81*b* of the communication passage 81, for example. The valve body 102 is a member which is displaced so as to open and close the hole of the valve seat 101. The solenoid 103 drives the valve body 102 to open and close. Usually the solenoid 103 is in an unexcited state, closing the valve body 102 as shown in FIG. 10 (the electromagnetic valve 100 is in a closed state). The solenoid 103 then goes into an excited state only when an open signal is received from the controller 91, and the valve body 102 is opened (the communication valve 100 is in an open state).

Figure 11:
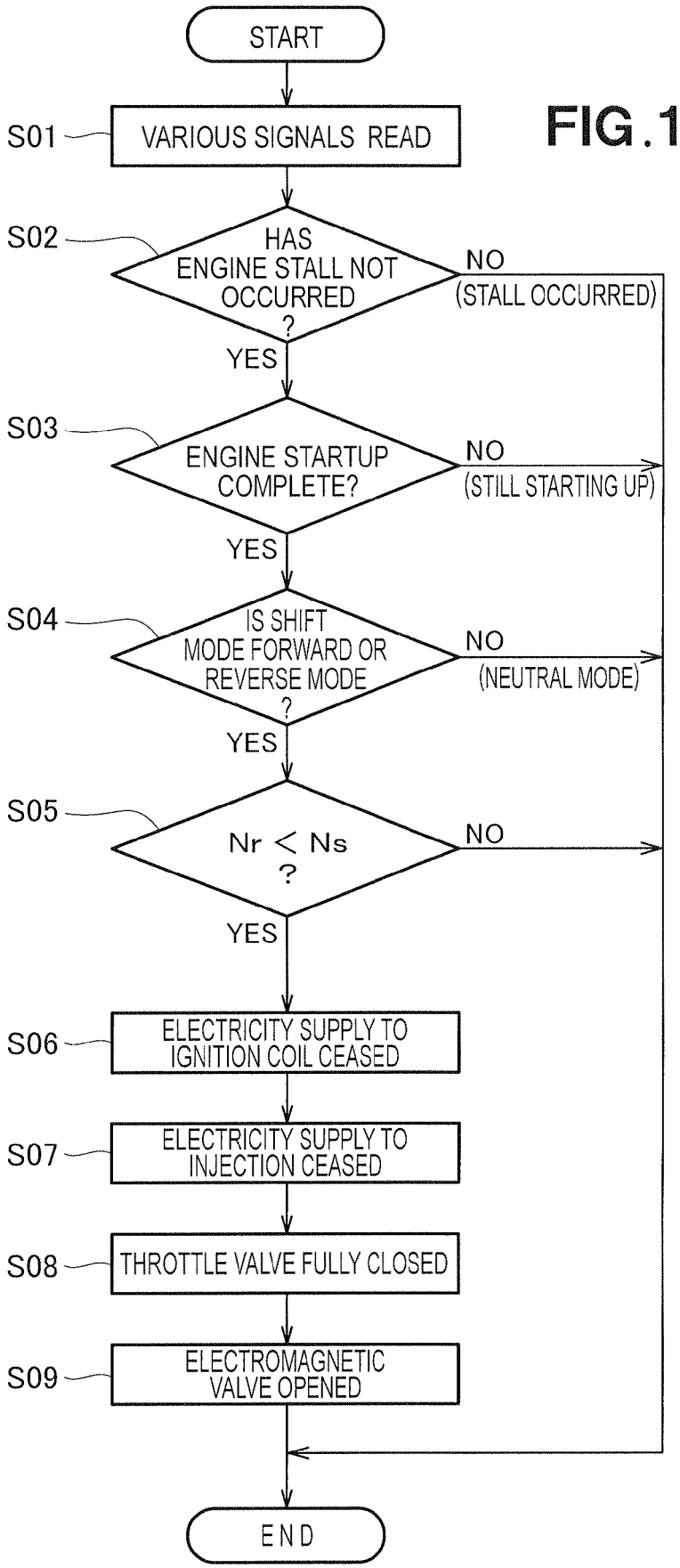
FIG. 11 is a control flowchart of a controller shown in FIG. 9.

The control flowchart shown in FIG. 11, whereby the controller 91 of the second embodiment performs control, is the same as the control flowchart of the first embodiment shown in FIG. 7, with the addition of a step S09. In other words, in step S09 following step S08, control is ended after the electromagnetic valve 100 is opened, as shown in FIG. 11.

Figure 12:
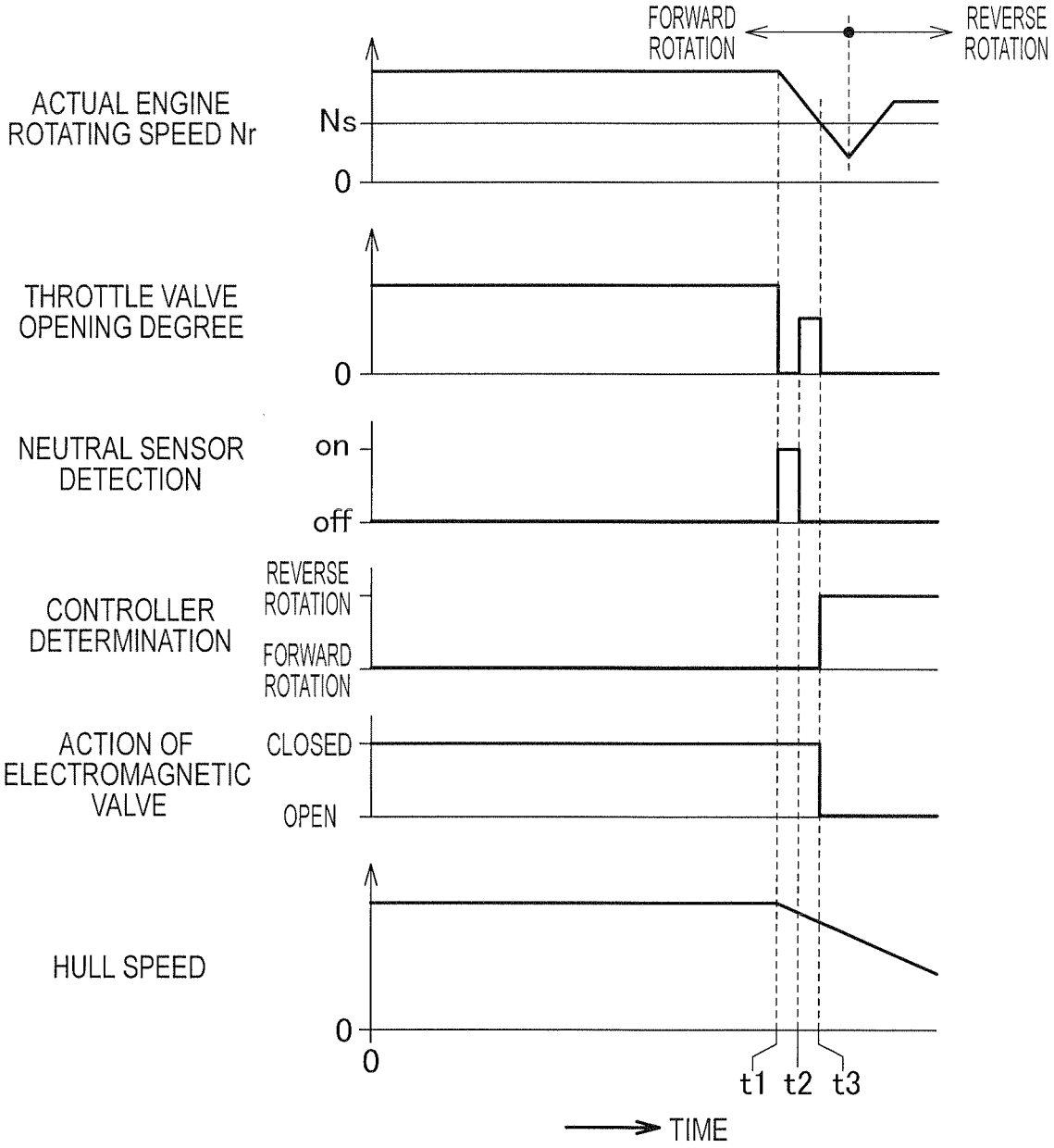
FIG. 12 is a time chart illustrating an operation of components of the outboard motor shown in FIG. 9.

FIG. 12 shows an example of the action of the outboard motor 10A of the second embodiment and the hull Si equipped with the outboard motor 10A, wherein the horizontal axes represent elapsed time and the vertical axes represent the actions of the components. The action of the second embodiment shown in FIG. 12 has substantially the same specifics as the action of the first embodiment shown in FIG. 8, with the addition of the action of the electromagnetic valve 100 (the communication valve 100) being shown.

In the second embodiment, the actual rotating speed Nr of the engine 14 (i.e. the rotating speed in the forward rotating direction+Nr) decreases due to the reverse force fp (not shown) being greater than the engine motive power fe (not shown), and when the actual rotating speed Nr falls below the engine lower limit reference speed Ns, i.e. at time t3, the controller 91 acknowledges (determines) that reverse rotation is occurring in the engine 14, closes the throttle valve 62 to the fully closed state, stops the engine 14, and also opens the electromagnetic valve 100.

The internal pressure P1 of the air intake manifold 63 becomes positive pressure due to the air flowing back in from the engine 14. When reverse rotation is occurring in the engine 14, the internal pressure P2 of the exhaust passage 70 becomes negative pressure. Moreover, since the electromagnetic valve 100 opens, the air in the air intake manifold 63 flows into the exhaust passage 70 via the electromagnetic valve 100 and the communication passage 81. As a result, the negative pressure state of the exhaust passage 70 is relieved.

In addition to exhibiting the essential actions and effects of the first embodiment, the second embodiment also exhibits the following actions and effects. The communication valve 100 is configured from an electromagnetic valve controlled by the controller 91. Therefore, when the controller 91 determines that reverse rotation is occurring in the engine 14, the electromagnetic valve 100 can be opened substantially at the same time that the throttle valve 62 is closed to the fully closed state. In other words, the electromagnetic valve 100 can be opened even before the pressure difference between the internal pressure P1 of the air intake manifold 63 and the internal pressure P2 of the exhaust passage 70 reaches a specified value. The negative pressure state of the exhaust passage 70 can be relieved even more quickly.

The present invention is suitable for use in an outboard motor in which a shift mechanism can be switched between forward and reverse during high-speed travel.

Obviously, various minor changes and modifications of the present invention are possible in light of the above teaching. It is therefore to be understood that within the scope of the appended claims the invention may be practiced otherwise than as specifically described.

What is claimed is:

1. An outboard motor in which exhaust produced by driving of an engine is emitted into water via an exhaust passage, comprising:

a throttle valve connected to an air intake port of the engine via an air intake manifold, a control motor for driving the throttle valve to open and close; and a controller for controlling the control motor, wherein the controller is configured to control the control motor such that the throttle valve fully closes when a decision is made that reverse rotation is occurring in the engine by determining that an actual engine rotating speed is less than a lower limit reference speed for said engine, the exhaust passage communicates with the air intake manifold via a communication passage, and a communication valve which opens only when reverse rotation is occurring in the engine is located in a portion where the communication passage and the air intake manifold are connected.

2. The outboard motor of claim 1, wherein the communication valve comprises a check valve which opens when an internal pressure of the air intake manifold is higher than an internal pressure of the exhaust passage.

3. The outboard motor of claim 1, wherein the communication valve comprises an electromagnetic valve, and the controller controls the electromagnetic valve to open when a decision is made that reverse rotation is occurring in the engine.

* * * * *